United States Patent [19]

Stuart et al.

[11] Patent Number: 5,054,144

[45] Date of Patent: Oct. 8, 1991

[54] TILTABLE AND HORIZONTALLY ADJUSTABLE LEG OR FOOT REST

[76] Inventors: James C. Stuart; Carole M. Stuart, both of #15 McCarty Trailer Park, Louisiana, Mo. 63353

[21] Appl. No.: 562,097

[22] Filed: Feb. 7, 1991

[51] Int. Cl.[5] ..... A47C 20/04

[52] U.S. Cl. ..... 5/443; 5/433; 297/439

[58] Field of Search ..... 5/443, 444, 432, 433, 5/431, 80; 297/439, 438; D6/353

[56] References Cited

U.S. PATENT DOCUMENTS

| | | | |
|---|---|---|---|
| D. 195,621 | 7/1963 | Langbaum | 297/438 |
| 269,780 | 12/1882 | Fenny | 297/439 |
| 789,813 | 5/1905 | Longley | 297/439 |
| 1,296,722 | 3/1919 | Washburn | 5/443 |
| 2,528,331 | 10/1950 | Bell | 297/439 |
| 2,579,577 | 12/1951 | Hill | 207/439 |
| 2,581,110 | 1/1952 | Kenworthy | 5/444 |
| 2,675,862 | 4/1954 | Eichorst | 297/462 |
| 2,869,620 | 1/1959 | Gleitsman | 297/439 |
| 2,907,375 | 10/1959 | Gleitsman et al. | 297/439 |
| 2,912,046 | 11/1959 | Fuerst | 297/439 |
| 2,950,753 | 8/1960 | Gleitsman et al. | 297/462 |
| 3,163,468 | 12/1964 | Koch | 297/439 |
| 3,940,181 | 2/1976 | Cheek, Jr. | 297/439 |
| 4,228,745 | 10/1980 | Gale | 108/116 |
| 4,692,954 | 9/1987 | Scott, Sr. | 5/443 |
| 4,901,385 | 5/1990 | Adolphson | 5/443 |

FOREIGN PATENT DOCUMENTS

| | | | |
|---|---|---|---|
| 475589 | 6/1937 | United Kingdom | 5/444 |
| 470705 | 8/1937 | United Kingdom | 297/439 |

*Primary Examiner*—Alexander Grosz
*Attorney, Agent, or Firm*—Grace J. Fishel

[57] ABSTRACT

A leg or foot rest with a cushion support member which is horizontally and tiltably adjustable to the comfort of a user. The cushion support member is mounted on a platform and the platform is mounted on a base. Clips or the like are provided on the cushion support member for attaching it to the platform in a manner which permits the cushion support member to be moved on the platform towards and away from the user. Joints or the like are provided between the platform and its base which permit the platform to be tilted with respect to the base.

10 Claims, 3 Drawing Sheets

TILTABLE AND HORIZONTALLY ADJUSTABLE LEG OR FOOT REST

The present invention relates to a leg or foot rest with a horizontally adjustable cushion support member.

BACKGROUND OF THE INVENTION

There are many leg or foot rests having a padded platform which is vertically adjustable to position the padded platform at a comfortable level with respect to the seat of a chair. Frequently, the padded platform is also tiltably adjustable for more comfortable use with a chair. The combination of a chair and such a vertically and tiltably adjustable rest can be used as a substitute for a recliner chair. This is desirable because recliner chairs (while comfortable to sit in) are relatively expensive, cumbersome and do not readily lend themselves to a decorative scheme.

One problem with existing leg and foot rest and chair combinations is that there is no way to adjust the rest so that it is comfortably positioned under the user's calves. In procrustean style, one size fits all, catching short people at the ankle and tall people somewhere between the calf and the knee. In view of the above, there is a need for a leg or foot rest with a cushion support member which is horizontally adjustable to fit the user's needs.

SUMMARY OF THE INVENTION

A main feature of the present invention is to provide a leg or foot rest having a means for horizontally adjusting a cushion support member on a platform. The platform is mounted on a base. Means are provided for mounting and horizontally adjusting the cushion support member on the platform such that it is adjustable towards and away from the user. Additional features found in a preferred embodiment of the invention include means for tiltably adjusting the platform with respect to the base.

An important object of the present invention is to provide a leg and foot rest with a cushion support member which is horizontally adjustable to the user's needs.

Another object is to provide a leg and foot rest which in a preferred embodiment is tiltably adjustable, making the rest more adaptable to the user's needs and adaptable to its use as a back rest.

Other objects and features of the invention will be in part apparent and in part pointed out hereinafter.

The invention accordingly comprises the constructions hereinafter described, the scope of the invention being indicated by the subjoined claims.

BRIEF DESCRIPTION OF THE DRAWINGS

In the accompanying drawings, in which one of various possible embodiments of the invention is illustrated, corresponding reference characters refer to corresponding parts throughout the several views of the drawings and in which:

FIG. 6 is a side elevation view of the leg or foot rest shown in use as a foot rest in a hospital bed or the like.

DETAILED DESCRIPTION OF THE INVENTION

Figure 1:
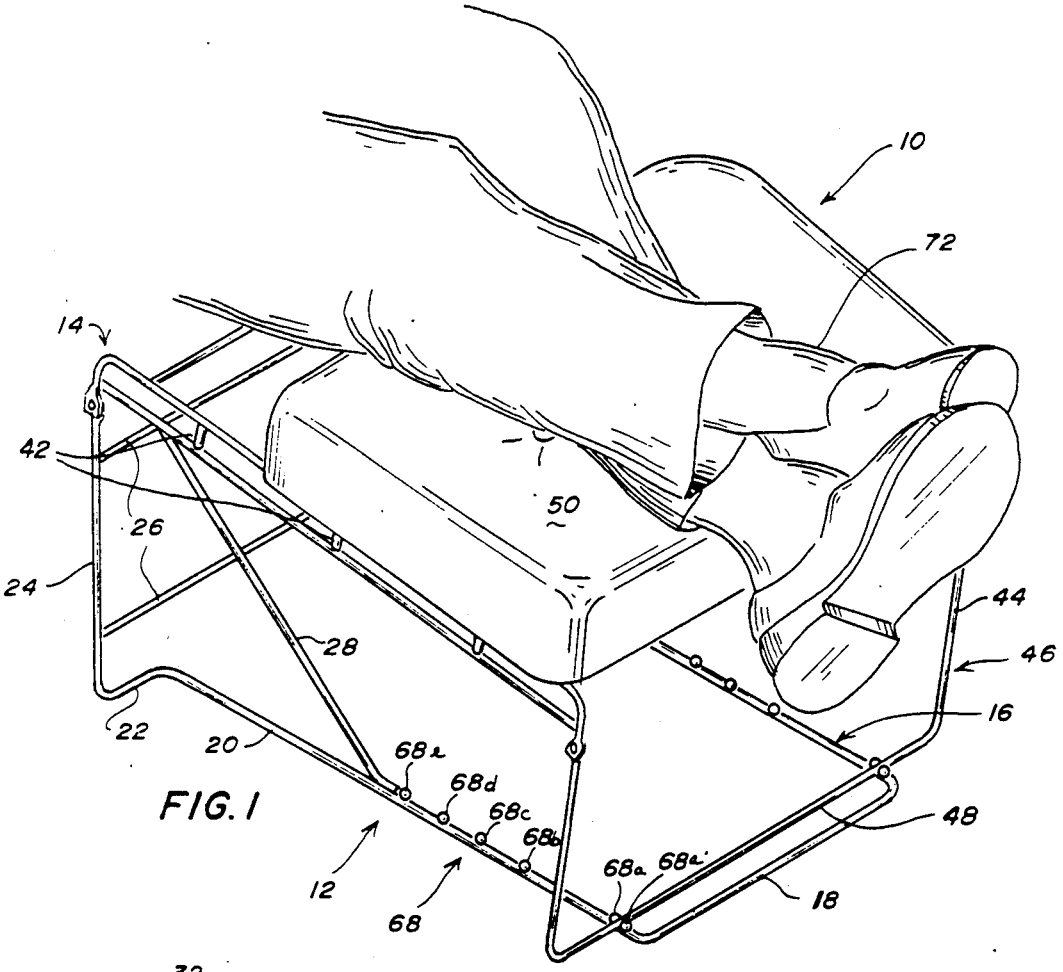
FIG. 1 is a perspective view of a leg or foot rest in use in accordance with the present invention.

Referring to the drawings more particularly by reference character, a leg and foot rest 10 in accordance with the present invention is horizontally and tiltably adjustable to the needs of a user. Leg and foot rest 10 has a supporting base 12 and a platform 14 mounted on the base. As illustrated, base 12 is constructed of tubular or other material and is defined by a U-shaped bottom 16 with a generally flat bight 18 and arms 20 generally perpendicular thereto. Arms 20 terminate with outwardly directed serifs 22.

A pair of upright posts 24 form the rear supports for platform 14 and are attached to bottom 16 at the ends of serifs 22. The rear supports for platform 14 (i.e., posts 24) are braced with a pair of connecting rails 26, the upper one of which is tied to arms 20 with a pair of angular braces 28. This assembly is further braced with a short upright post 30 connecting rails 26. Posts 24 can be integrally formed with bottom 16 and like bottom 16, posts 24, connecting rails 26, angular braces 28 and post 30 are constructed of tubular or other material.

Platform 14 is also constructed of tubular or other material and is defined by a openwork channel with a pair of U-shaped side flanges 32 (sans-serif) with arms 34 and an elongated bight portion 36. U-shaped side flanges 32 are joined along their bight portions 36 with a pair of connecting rails 38. Each of side flanges 32 is stiffened with a long brace 40 connecting arms 34 and with a plurality of shorter braces 42 joining braces 40 with bight portions 36 of the U-shaped side flanges.

Figure 2:
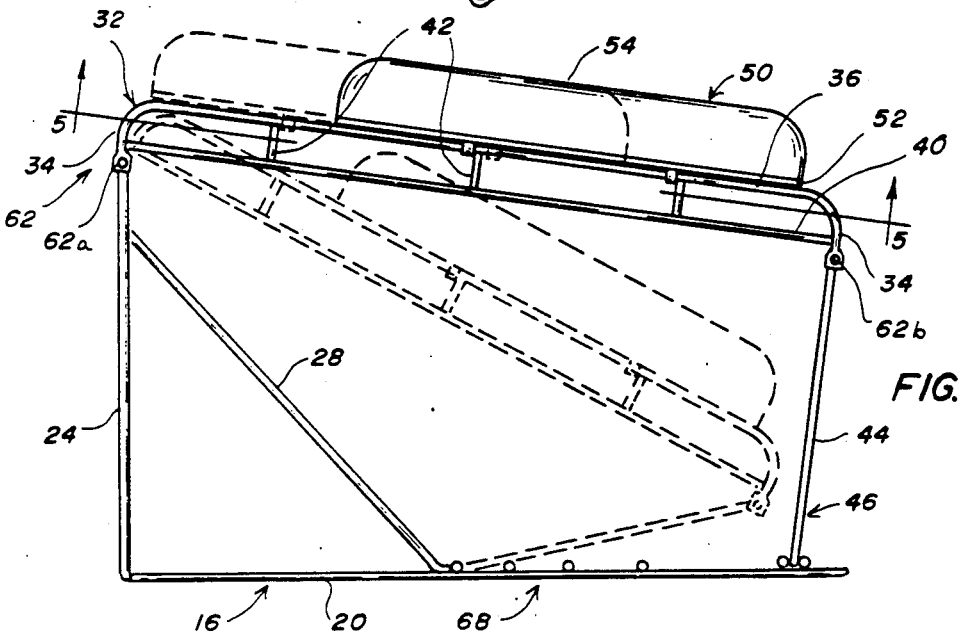
FIG. 2 is a side elevation view of the leg or foot rest with selected horizontal and tiltable positions shown in broken lines.

A pair of upright posts 44 form the front supports for platform 14 and are attached to one end of arms 34 of U-shaped side flanges 32. Posts 44 are preferably formed as an integral part of a U-shaped member 46 which, like the rest of the frame, is constructed of tubular or other material. In U-shaped member 46, posts 44 are generally perpendicular to a flatten bight 48. As best seen in FIG. 2, posts 44 are slightly shorter than posts 24 so that platform 14 has a slight slope towards the front (to discourage standing on leg or foot rest 10) even when posts 44 are in fully erect position as shown in full lines.

A cushion support member 50 is attached to platform 14 in a manner which is more particularly described below. Cushion support member 50 preferably includes a plate 52 of any suitable geometric configuration (specifically illustrated as rectangular). The upper surface of plate 52 is preferably padded and upholstered providing a cushion 54 for the comfort of the user.

A means 56 for mounting and horizontally adjusting cushion support member 50 on platform 14 is provided. In the embodiment illustrated, means 56 comprises clips attached to the underside of cushion support member 50. Clips 56 grip bight portions 36 of U-shaped side flanges 32 and allow cushion support member 50 to be reciprocated by the user back and forth on platform 14.

Figure 5:
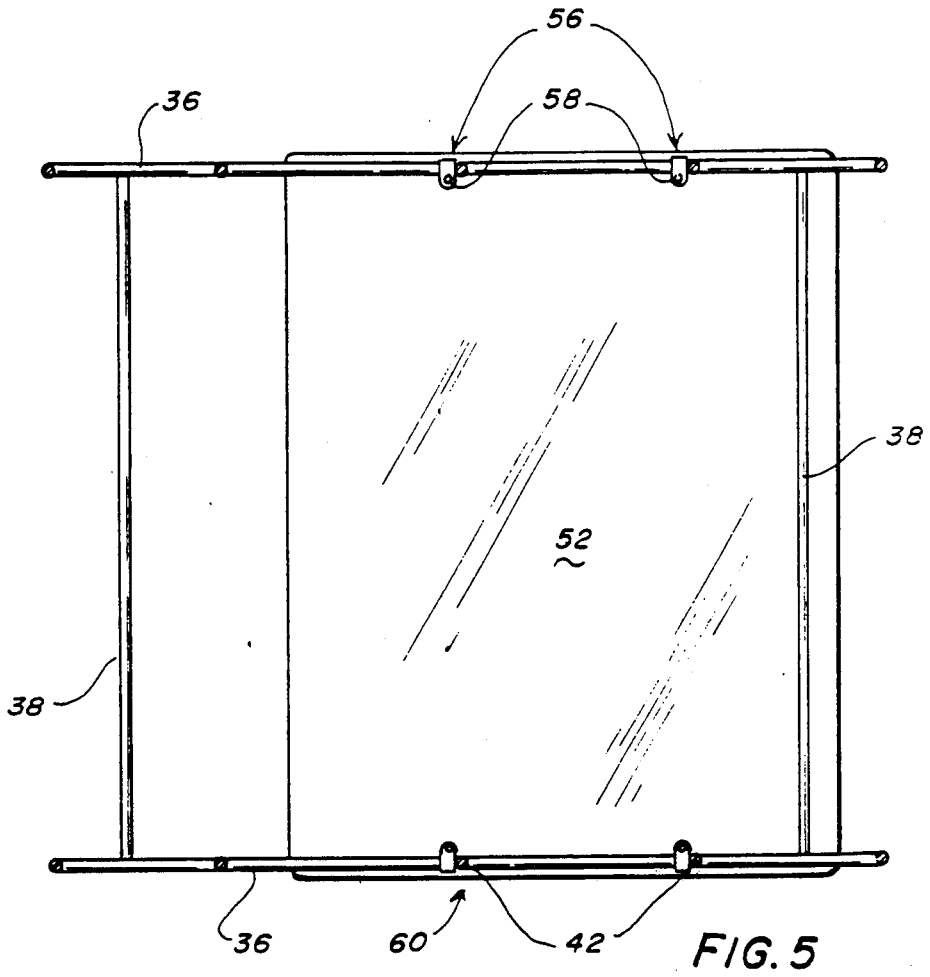
FIG. 5 is a sectional view taken along line 5—5 in FIG. 2.

Clips 56 can take a variety of forms which will occur to those skilled in the art but can be economically served by a plurality of U-shaped nylon clips having a pair of free ends joined with a loop. As shown in FIG. 5, the loop engages bight portion 36 of U-shaped side flanges 32 and the free ends are attached to plate 52 with screws 58. The loop is tight enough to provide some frictional resistance such that cushion support member 50 tends to remain in the position selected by the user but loose enough such that cushion support member 50 can be reciprocated back and forth on platform 14. A stop means 60 is provided on platform 14 for confining the movement of cushion support member 50 between forward and rear limits. As illustrated, this function is served by short braces 42.

In the embodiment of leg and foot rest 10 illustrated in the drawings, a means 62 is provided for tiltably adjusting platform 14 with respect to base 12. As best seen in FIG. 2, means 62 comprise joints 62*a* and 62*b*. More particularly, joints 62*b* are provided at the top of posts 44 and permit U-shaped member 46 to pivot inwardly towards rear supports 24. Joints 62*a*, on the other hand, are provided at the top of posts 24 and permit platform 14 to pivot about its rear edge downwardly towards base 12.

Figure 3:
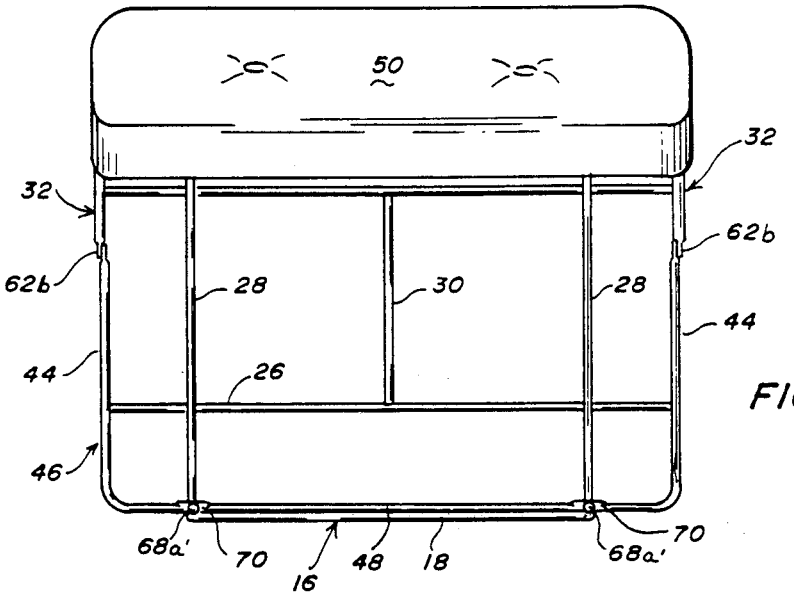
FIG. 3 is a front elevation view of the leg or foot rest.
Figure 4:
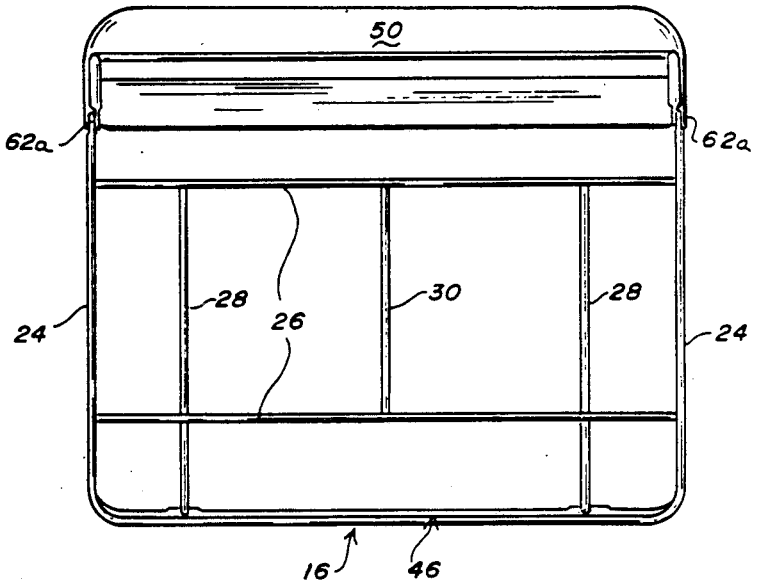
FIG. 4 is a rear elevation view of the leg or foot rest.

A means 68 is provided for stopping the means for tiltably adjusting platform 14 at a selected angle. In the form illustrated, means 68 comprise a plurality of generally spherical buttons positioned at intervals along arms 20 of U-shaped bottom 16. The first two such buttons (68*a*, 68*a*') hold U-shaped member 46 by bight 48 such that posts 44 are in fully erect position as shown in full lines in FIGS. 2. The third through sixth buttons (68*b*, 68*c*, 68*d* and 68*e*) hold bight 48 such that posts 44 are folded at increasingly sharper angles with respect to platform 14. As best seen in FIG. 3, bight 48 is flattened into a knife edge 70 at its point of contact with buttons 68. Knife edge 70 is co-planar with U-shaped member 46 and slides under a portion of spherical buttons 68, latching in bight 48 against inadvertent displacement and folding of posts 44.

In use as shown in FIG. 1, leg and foot rest 10 can be used with a chair (not shown) with posts 24 positioned near the seat such that a user can extend his legs 72 onto cushion support member 50. Using his hands or the back of the heels of his feet, the user can slide cushion support member 50 towards or away from him (as shown in broken and full lines in FIG. 2) by means 56 such that cushion 54 is comfortably located under his calves. With continuing reference to FIG. 2, means 56 (illustrated as clips) are spaced apart a distance corresponding to the spacing between short braces 42 and straddling a center member thereof. Short braces 42 form stop means 60 and limit the movement of cushion support member 50 between inner and outer limits. If the user also wants platform 14 to be tilted, platform 14 is lifted such that knife edge 70 is released from between buttons 68*a*, 68*a*'. Posts 44 are then bent inwardly about means 62 (joints 62*b*) while platform 14 is rotated on means 62 (joints 62*a*) about its rear edge. When platform 14 is at the desired angle, bight 48 is latched under selected button 68 (68*b* through 68*e*).

Figure 6:
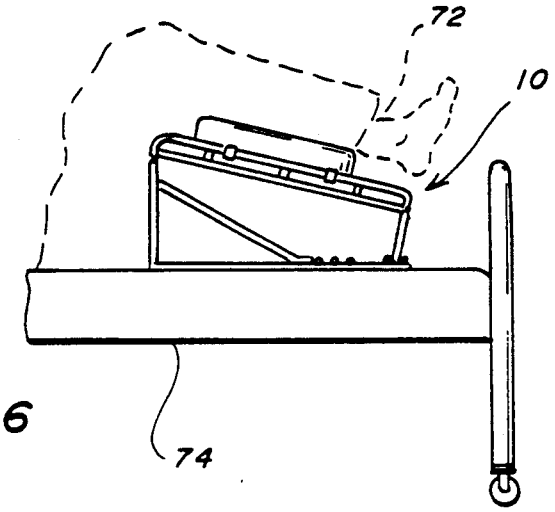

As shown in FIG. 6, leg and foot rest 10 can be used to elevate the user's legs 72 in a bed 74. It can also be used as a backrest, particularly when it is in fully tilted condition as shown in broken lines in FIG. 2.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. A leg or foot rest comprising:

a base, a platform, said platform defined by an openwork channel having a pair of U-shaped side flanges with arms and an elongated bight, said U-shaped side flanges joined together by a connecting rail and mounted by their arms to the base on front and rear supports;

a cushion support member;

a means for mounting and horizontally and slidably adjusting the cushion support member on the platform;

and means for tiltably adjusting, at selected angles, the platform with respect to the base, said means for tiltably adjusting defined by joints on the front and rear supports permitting the front supports to fold towards the rear supports and the platform to fold towards the base.

2. The leg or foot rest of claim 1 having a stop means on the bight of the U-shaped flanges for confining the movement of the cushion support means between a forward and a rear limit.

3. The leg or foot rest of claim 1 with a stop means on the base for stopping the means for tiltably adjusting the platform at a selected angle.

4. The leg or foot rest of claim 1, wherein the means for mounting and horizontally adjusting is defined by clips attached to the cushion support member, said clips having a loop portion which engages the bight of the U-shaped flanges.

5. A leg or foot rest made of tubular material comprising:

a base defined by a U-shaped bottom with a generally flat bight and arms generally perpendicular thereto;

a platform, said platform defined by an openwork channel having a pair of U-shaped side flanges with arms and an elongated bight, said U-shaped side flanges joined together by a connecting rail and mounted by their arms to the base on front and rear supports;

a cushion support member defined by a cushion mounted on a plate;

a means for mounting and horizontally and slidably adjusting the cushion support member on the platform;

and means for tiltably adjusting, at selected angles, the platform with respect to the base, said means for tiltably adjusting defined by joints on the front and rear supports permitting the front supports to fold towards the rear supports and the platform to fold towards the base.

6. The leg or foot rest of claim 5 wherein the front supports are defined by a U-shaped member and the rear supports are defined by posts integrally formed with the arms of the U-shaped bottom.

7. The leg or foot rest of claim 6 having a stop means on the bight of the U-shaped flanges for confining the movement of the cushion support means between a forward and a rear limit.

8. The leg or foot rest of claim 7 with a stop means on the base for stopping the means for tiltably adjusting the platform at a selected angle.

9. The leg or foot rest of claim 8 wherein the stop means for stopping the tiltably adjustable means are a plurality of spaced apart buttons on the arms of the U-shaped bottom.

10. The leg or foot rest of claim 5 wherein the means for mounting and horizontally adjusting is defined by clips attached to the cushion support member, said clips having a loop portion which engages the bight of the U-shaped flanges.

* * * * *